US005226554A

United States Patent [19]

Dauphinais

[11] Patent Number: 5,226,554

[45] Date of Patent: Jul. 13, 1993

[54] REMOVABLE, ADJUSTABLE PROTECTING-LINER FOR USE INSIDE OF TRASH BAGS

[76] Inventor: Richard J. Dauphinais, 6564 Burr, Taylor, Mich. 48180

[21] Appl. No.: 794,566

[22] Filed: Nov. 19, 1991

[51] Int. Cl.[5] ..... B65D 3/04

[52] U.S. Cl. ..... 220/402; 220/469; 141/316; 141/390; 141/391; 141/392; 248/97; 248/99

[58] Field of Search ..... 220/402, 469, 404; 141/316, 390, 391, 392; 248/97, 99

[56] References Cited

U.S. PATENT DOCUMENTS

| | | | |
|---|---|---|---|
| 1,879,410 | 9/1932 | Morris et al. | 141/390 X |
| 1,975,510 | 10/1934 | Hiatt | 217/3 FC X |
| 3,915,329 | 10/1975 | Zaks | 141/390 X |
| 3,937,354 | 2/1976 | Clar | 220/402 |
| 3,983,914 | 10/1976 | Benson | 141/390 |
| 4,037,778 | 7/1977 | Boyle | 141/390 |
| 4,457,483 | 7/1984 | Gagne | 141/390 X |
| 4,749,011 | 6/1988 | Rylander | 141/316 |
| 4,955,496 | 9/1990 | Nelson | 141/316 X |
| 4,979,547 | 12/1990 | Hoerner | 141/390 |
| 5,056,679 | 10/1991 | Lonczak | 220/404 |

*Primary Examiner*—Gary E. Elkins
*Assistant Examiner*—Stephen Cronin
*Attorney, Agent, or Firm*—Charles W. Chandler

[57] ABSTRACT

A protective liner for removable insertion into a trash bag or other container comprises an essentially rectangular sheet of strong, flexible material The dimensions of the liner are tailored to the dimensions of the bag or container into which it is to be placed. The preferred embodiment is provided with locking means at one corner, a rounded adjacent corner and is made of one millimeter thick polyethylene. The preferred embodiment is particularly adapted to be suitable for use with the broad category of trash bags known as 30-gallon trash bags.

In use, the liner is rolled along its longer axis into a cylinder with an effective diameter smaller than that of the associated container, the overlapping material is pinched together, the cylinder is inserted into the container, and compression is released (allowing the liner to expand to fill the container). Optionally, the liner is locked in place. The container may then be filled with little danger of puncturing the sides. After filling, the liner may be unlocked (if appropriate) and retracted upward.

7 Claims, 3 Drawing Sheets

12
10

REMOVABLE, ADJUSTABLE PROTECTING-LINER FOR USE INSIDE OF TRASH BAGS

TECHNICAL FIELD OF THE INVENTION

The technical field of the present invention is that of devices and methods for facilitating the use of trash bags or other relatively delicate-sided containers. Specifically, the present invention concerns devices and methods used to hold open trash bags, to protect the bag while it is being filled, and to protect the bag while its contents are compacted. More specifically, the present invention concerns devices that are placed inside of a trash bag and are removable, adjustable in size, and, if desired, able to be locked.

BACKGROUND INFORMATION

The thin-wall, plastic trash bag is ubiquitous. Its uses are legion. Its inherent limitations are well known and include: a tendency for its thin walls to be punctured or torn by firm objects located both inside and outside of the bag; and, because of the bag's limp nature, one encounters difficulty in simultaneously opening the bag and filling it.

It is known in the art to endeavor to overcome these limitations by loosely placing a bag inside of a rigid cavity and detachably securing the opening of the bag to the top of the cavity. After the bag has been filled, one is to lift the bag out of the cavity. Since the bag must scrape against the cavity while it is removed, resulting tears are not unknown. Compression of the contents of the bag while it is inside of the cavity often results in a puncture or tear. Since the bag is generally loose when inside of the cavity, it is not possible completely to fill such a bag when it is inside of the cavity even with soft, light objects.

Among the objects of the present invention is a removable liner, primarily for use inside of a trash bag, that protects the bag from injury and facilitates filling the bag. Furthermore, it is an object of the present invention that the liner allow filling a trash bag, or the like, up to its maximum capacity. Additional objects of the present invention include optional means for temporarily locking the liner open, and facilitating the filling a trash bag by one person.

SUMMARY OF THE INVENTION

The present liner invention is a device that satisfies the aforementioned objects. It comprises an essentially rectangular sheet of strong, flexible material. The dimensions of the liner are tailored to the dimensions of the bag or container into which it is to be placed. The preferred embodiment is provided with locking means at one corner and a rounded adjacent corner. The preferred embodiment is particularly adapted to be suitable for use with the broad category of trash bags known as 30-gallon trash bags.

In use, the liner is rolled along its longer axis into a cylinder with an effective diameter smaller than that of the associated container, the overlapping material is pinched together, the cylinder is inserted into the container, and compression is released (allowing the liner to expand to fill the container). Optionally, the liner is locked in place. The container may then be filled with little danger of puncturing the sides. After filling, the liner may be unlocked (if appropriate) and retracted upward.

DETAILED DESCRIPTION OF THE INVENTION AND ITS PREFERRED EMBODIMENT

Figure 1:
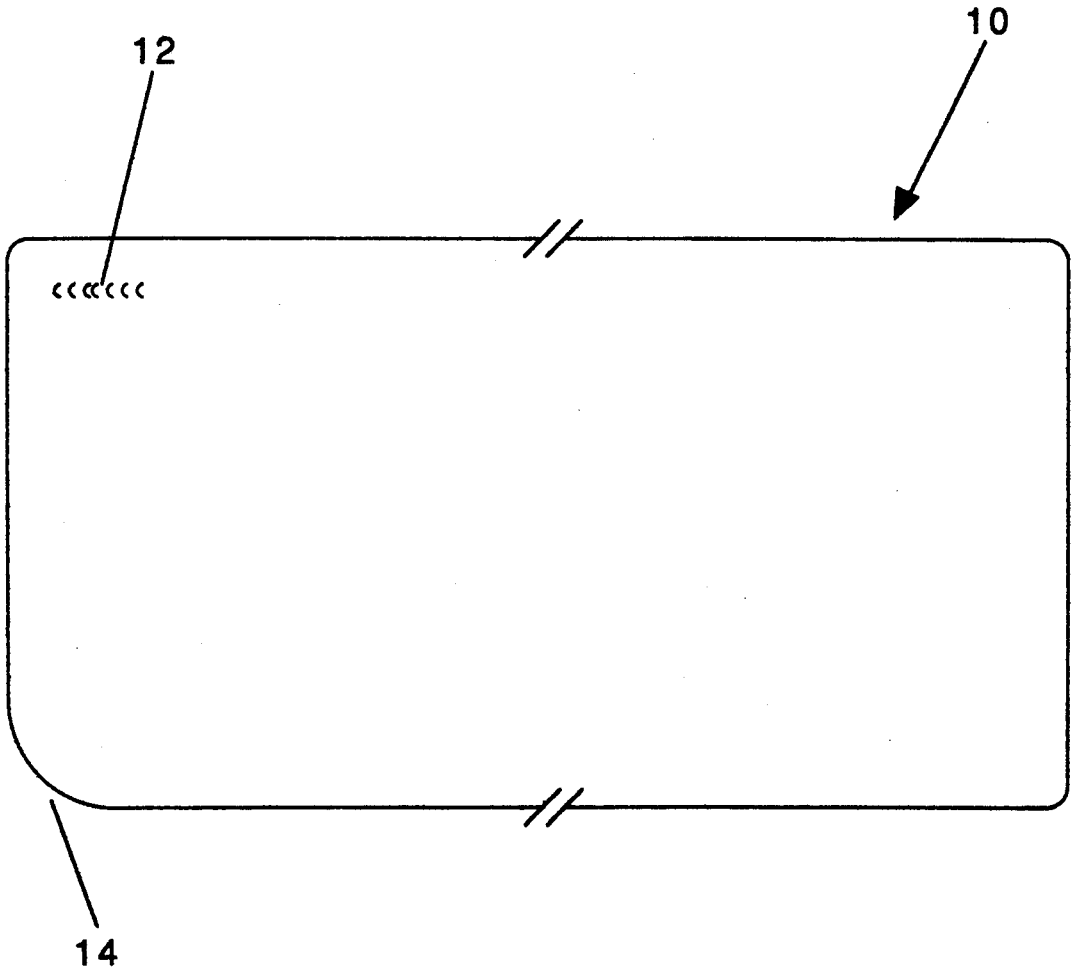
FIG. 1 is a side view of the liner when flat.

The general nature of the preferred embodiment of the liner 10 may be seen on FIG. 1 as that of a generally rectangular sheet of strong, flexible material pierced by strategically located cuts that form the locks 12. The locks 12 are placed in the neighborhood of one corner with the adjacent corner comprising the rounded corner 14.

The strong, flexible material of the liner 10 may include chipboard of 0.042 inch thickness, polyboard of 0.025 inch thickness, or polyethylene of 0.040 inch thickness. In the preferred embodiment of the invention, a liner suitable for so called 30 gallon trash bags, the material used is polyethylene of 0.040 inch (about one millimeter) thickness.

The dimensions of the essentially rectangular liner 10, when viewed as a flat sheet, are proportional to the size of the trash bag or container that it will be used with and to the extent it is desired to fill the container. If it is desired to fill a trash bag, or other container, completely then the height of liner 10 should be a few inches greater than the effective height of the trash bag and the width of liner 10 should be a few inches greater than the effective circumference of the trash bag. If it is desired not to fill a trash bag, or other container, completely (perhaps because the filling material is relatively dense) then the height of liner 10 should be about the same as the desired maximum effective height of the filling material and the width of liner 10 should be slightly more than the effective circumference of the trash bag. In the preferred embodiment, a liner suitable for filling a so called 30 gallon trash bag, the dimensions are nominally 67 inches by 24 inches when the liner is flat.

Three of the corners of the liner 10 are slightly rounded, primarily to protect the user from what otherwise would be a sharp, pointed corner. Rounded corner 14 points into the side of a bag when the liner 10 is placed into a trash bag. Rounded corner 14 has a greater degree of rounding so that it will not tear the bag. In the preferred embodiment of the invention, rounded corner 14 has a rounding that is equivalent to about a six inch circular radius.

Figure 3:
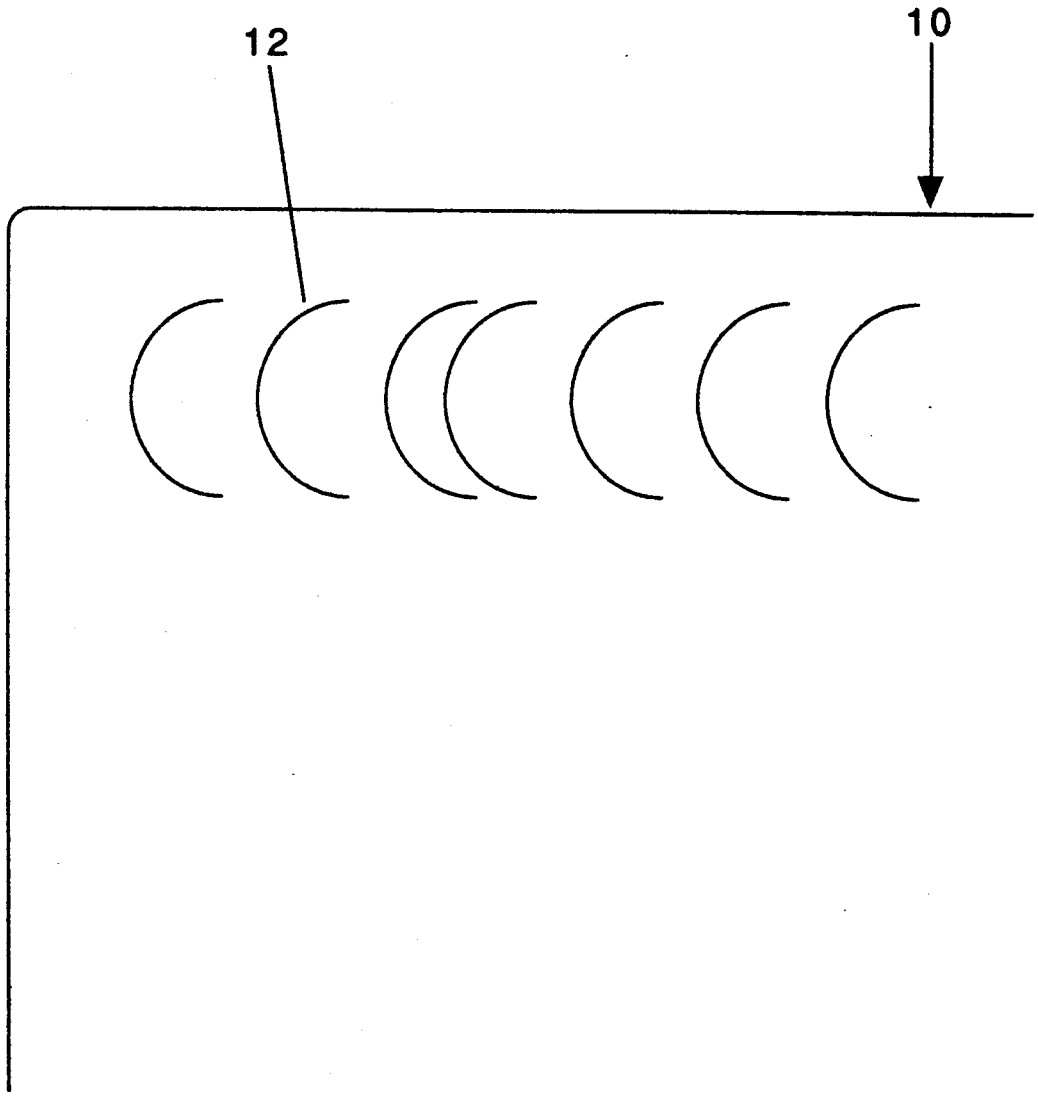
FIG. 3 is an expanded view of the lock containing corner of the preferred embodiment.

The locks 12 may be any type of fastener that will detachably secure one side of liner 10 to another side of liner 10. Locks that are only present at the top of the liner, or are otherwise reliably actuated from the top of the liner, are preferred. When locks extend along the height of a liner they have as an advantage more secure confining of the contents, but generally have as a disadvantage the need to extend one's arm deep into the bag to effect closure. While the preferred embodiment has locks 12 only near a corner, the invention encompasses locks that extend along a vertical edge of liner 10 or are otherwise positioned so as to allow a detachable closure. In the preferred embodiment, a liner suitable for use with a so called 30 gallon trash bag, locks 12 are implemented by cutting a horizontal row of what are essentially semicircles or "C" cuts. Details of these "C" cuts may be seen on FIG. 3. Each "C" faces away from the nearest vertical edge of liner 10. The center line of the row is approximately four inches below the top edge of liner 10. The radius of each semicircle is about ¾ inches. A total of seven "C" cuts are made extending from about 1.6 inches from the nearest vertical edge of liner 10 to about 9½ inches from the same edge. Two of the seven "C" cuts are closer together, than the other five, in the neighborhood of where the majority of 30 gallon trash bags lock. The quantity, spacing, and horizontal extent of the "C" cuts is necessitated by the variability of the diameters of commercially available 30 gallon trash bags. In other words, for the preferred embodiment of the invention to work satisfactorily with the wide variety of what are sold as 30 gallon trash bags, about eight inches of circumference adjustment must be provided in the design of the locks. Should the invention be used with bags having a known and constant effective diameter, one or two locks would be sufficient.

Numerous kinds of locking means are possible. The use of a two ore more mating creases extending along the vertical edges of the liner has proven effective, however such means are more expensive to implement and less desired by the user because of the need to reach into the bag to effect closure. One or more mating patches of VELCRO® brand hook and loop fasteners are expected to be effective. Other means will occur to one skilled in the art.

Locks (or other means for attachment) are not a necessary part of the present invention. Even if provided, the user of the present invention may elect not to use the locks. If, shortly after the present invention is inserted into a trash bag, or other container, the user partially fills the bag then the forces produced by the contents tend to hold the liner 10 in place even if the locks 12 have not been activated.

Figure 2:
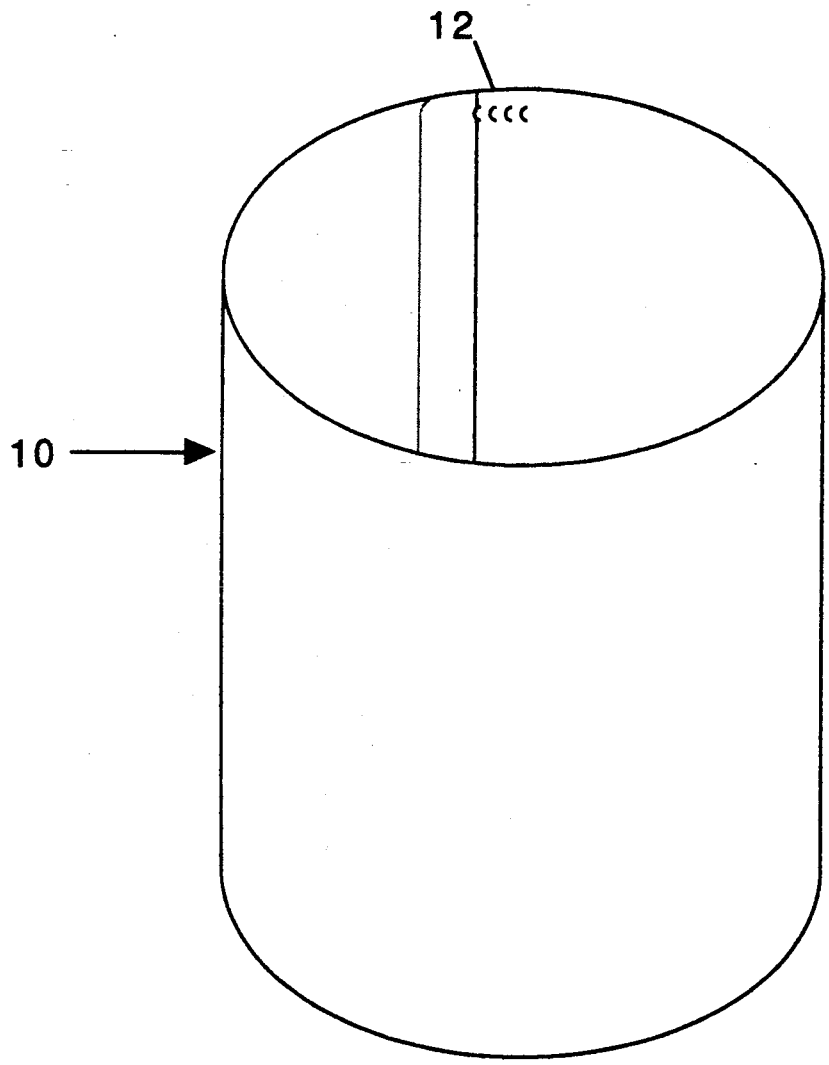
FIG. 2 is a perspective view of the preferred embodiment of the liner formed inside of a trash bag.

The primary method of use may be seen on FIG. 2 and comprises rolling the liner into an approximation of a cylinder or tube, inserting it into a bag, locking it into place (if desired), filling the bag, and removing the liner. Liner 10 is rolled upon itself, along its longer axis, starting at the vertical side farthest from the locks 12 and is formed into a cylinder or tube of somewhat overlapping material that has a diameter smaller than the effective diameter of the trash bag. Rounded corner 14 is on the outside of the cylinder. Pinching or compressing the overlapping material together in the vicinity of locks 12 with the right hand, the cylinder is inserted into a trash bag that is shaken open with the left hand. When the cylinder's far end is near the bottom of the trash bag, compression is reduced by the right hand allowing the cylinder partially to un-coil filling the volume of the trash bag with liner 10. Locks 12 are then selectively activated to lock the diameter of liner 10 to be commensurate with the effective diameter of the trash bag. (Left hand and right hand may be interchanged in the above description.) (Any container with an opening may be substituted for the trash bag of the above description.)

Having inserted liner 10 into the trash bag, with part of liner 10 protruding from the open end of the bag, one may insert trash or other objects into the bag. One may also compact objects in the bag. One may even use the end of liner 10 that extends beyond the bag as a scoop. When desired, the liner 10 may be removed from the bag by loosening any locks 12 (or other means for attachment) and lifting liner 10 up and out of the bag. Though not used with the preferred embodiment, oblong holes having the width of a hand may be placed near the upper edges of the liner to act as handles and thus facilitate the retraction of the liner from a filled bag.

An experiment was conducted to estimate the extent of relative compaction possible when using the present invention. Identical 30 gallon bags were filled by conventional means with a mixture of leaves and grass cuttings. The conventionally filled bags were compacted as much as it appeared the bags would tolerate and were not tied. The contents of the conventionally filled bags were then used to fill identical bags using the present invention. It was found that an average of the contents of two and one-half (2½) conventionally filled bags could be safely and conveniently placed into a bag lined with the present invention. The liner was then retracted and the bag tied, all without injury to the bag. Differing ratios are expected when filling bags with different substances. It is appreciated that if one is placing dense objects such as magazines into a bag, the bag is likely to rupture before the bag is full. It is also appreciated that if one is filling a bag with sparse, sharp objects, like the twigs resulting from trimming a tree, higher ratios than 2½ are to be expected.

A tested preferred embodiment of the invention has been described in detail. The description of the preferred embodiment is illustrative and not restrictive.

I claim:

1. A protective liner insertable within a flexible trash bag so that the bag and liner can assume an upright expanded condition while trash is being deposited into the space circumscribed by the liner; said liner comprising a rectangular sheet of stiff flexible material devoid of creases or projections; said rectangular sheet having a top edge, a bottom edge, a first side edge, and a second side edge; the second side edge extending along a substantially continuous, linear line; the top and bottom edges and the first and second side edges each forming opposed outer boundaries of the liner; a single row of C-shaped slits formed in said sheet near the sheet top edge; said row of C-shaped slits proceeding from a point near said first side edge of the sheet and away therefrom along an imaginary line parallel to the sheet top edge; each C-shaped slit having its convex edge facing said first side edge and its concave edge facing away from said first side edge; each C-shaped slit forming a tab within the space circumscribed by the slit; each C-shaped slit being large enough so that the user can deflect the tab out of the sheet plane by exerting finger pressure on the tab surface; said liner being insertable into a flexible trash bag in a rolled up condition so that the axis of the roll is parallel to the sheet side edges, and so that the side edge area containing the C-shaped slits is located outside the other non-slit side edge area; said liner being capable of being partially unrolled while within a trash bag, such that said second side edge of the sheet is moved across the C-shaped slits to a position wherein the upper portion of the partially unrolled sheet substantially fills the space circumscribed by the bag; the tabs formed by said C-shaped slits being selectively deflectable out of the sheet plane away from the bag inner surface by inward finger pressure, such that said second side edge of the sheet extends between the selected tab and the first side edge of the sheet; said selected tab constituting a locking element to prevent the sheet from collapsing while it is inserted in the bag.

2. The liner of claim 1, wherein said sheet is formed of a stiff plastic material having a wall thickness of about 0.04 inch.

3. The liner of claim 1, wherein the corner formed by said first side edge and said bottom edge has a circular arcuate configuration with a radius of about six inches, whereby said arcuate corner has a lessened potential for catching against the bag surface.

4. The liner of claim 1, wherein said C-shaped slits are closely spaced, with the slit spacing being less than the vertical dimension of an individual slit.

5. The liner of claim 4, wherein each C-shaped slit has a vertical dimension of about one and one half inch.

6. The liner of claim 1, wherein there are approximately seven slits in said row of slits.

7. The liner of claim 6, wherein intermediate ones of the slits have a smaller slit spacing than the end ones of the slits.

* * * * *